US009751537B2

(12) United States Patent
Fang

(10) Patent No.: US 9,751,537 B2
(45) Date of Patent: Sep. 5, 2017

(54) HIGH-SPEED RAIL RESCUE CRANE AND A MULTIFUNCTIONAL HIGH-SPEED RAIL RESCUE TRAIN

(71) Applicant: Chen Fang, Wuhan (CN)

(72) Inventor: Chen Fang, Wuhan (CN)

( * ) Notice: Subject to any disclaimer, the term of this patent is extended or adjusted under 35 U.S.C. 154(b) by 178 days.

(21) Appl. No.: 14/427,306

(22) PCT Filed: Jun. 20, 2014

(86) PCT No.: PCT/CN2014/080379

§ 371 (c)(1),
(2) Date: Mar. 10, 2015

(87) PCT Pub. No.: WO2014/202018

PCT Pub. Date: Dec. 24, 2014

(65) Prior Publication Data

US 2015/0239479 A1 Aug. 27, 2015

(30) Foreign Application Priority Data

Jun. 21, 2013 (CN) ..... 2013 1 0251576
Jun. 21, 2013 (CN) ..... 2013 2 0361045 U

(51) Int. Cl.

| | |
|---|---|
| ***B61D 15/02*** | (2006.01) |
| ***B61D 15/00*** | (2006.01) |
| ***B66C 23/50*** | (2006.01) |
| ***B66C 23/78*** | (2006.01) |

(52) U.S. Cl.

CPC ..... *B61D 15/02* (2013.01); *B61D 15/00* (2013.01); *B66C 23/50* (2013.01); *B66C 23/78* (2013.01)

(58) Field of Classification Search

CPC ... B61D 3/00; B61D 3/02; B61D 3/08; B61D 3/10; B61D 3/16; B61D 3/18; B61D 3/181; B61D 3/182; B61D 3/184; B61D 15/00; B61D 15/02; B61D 15/04; B61D 15/06; B61D 15/08

See application file for complete search history.

(56) References Cited

U.S. PATENT DOCUMENTS 4,652,057 A * 3/1987 Engle ..... B60T 13/665 105/61
2002/0003119 A1* 1/2002 Rode ..... B66C 23/38 212/301

* cited by examiner

*Primary Examiner* — R. J. McCarry, Jr.

(57) ABSTRACT

The present application relates to a new high-speed rail rescue crane and a multifunctional high-speed rail rescue train, comprising a vehicle equipped with wheels; a concave floor disposed on middle of the vehicle floor; wherein a steel frame base is disposed on the concave floor; a cassette deck is set on both sides of the steel frame base and a V-type chute is set up on the cassette deck; a pedestal floor is disposed on the steel frame base, a sliding tenon is set on both sides of the pedestal floor, the sliding tenons is engaged with the V-type chute; an end of the pedestal floor is connected to a trip lever of a hydraulic cylinder fixed on the steel frame base; a rotary support is fixed on the pedestal floor, a crane is fixed on the pedestal floor; legs of the crane are disposed on the vehicle floor; and a slot engaged with a steel rail is disposed on root of the legs of the crane. The present high-speed rail wreck crane is safer, more stable and more practical; this multifunctional high-speed rail rescue train is suitable for the rescue of multi-type accidents of high-speed rail and it is also suitable in unique terrains, such as elevated sections, tunnels, canyons and water.

12 Claims, 2 Drawing Sheets

HIGH-SPEED RAIL RESCUE CRANE AND A MULTIFUNCTIONAL HIGH-SPEED RAIL RESCUE TRAIN

CROSS-REFERENCE TO RELATED APPLICATIONS

The present application claims priority to Chinese Patent Application No. 201310251576.0, filed Jul. 21, 2013; the disclosure of which is hereby incorporated by reference in its entirety.

TECHNICAL FIELD

The present application relates to high-speed rail rescue equipment, for example, to a new high-speed rail rescue crane and a multifunctional high-speed rail rescue train.

BACKGROUND

A high speed railway, also known as a high-speed rail, refers to a rail track that can be traveled at a speed of beyond 250 km/h. Compared to existing rail tracks, a high-speed rail demands higher accuracy and more precision with respect to the route slope, curve radius, running speed, driving equipment, etc. The high-speed rail line is often contains bridges connected with tunnels and tunnels connected with other tunnels. Many rail tracks are set up on bridges, tunnels and elevated sections. Some rail tracks are even set up in unique terrains such as rivers, lakes and oceans. The train internal track is only 5 minutes. So it is important to ensure security, accuracy, and scientific precision when running a high-speed rail. The high-speed rail provides many advantages, such as being fast, convenient, elegant and comfortable. However, equipment failure, nature disasters and other factors may lead to accidents, which can cause very serious injury. Especially on bridges, tunnels and elevated sections, it is very difficult to rescue the injured from the accidents. The current wreck crane cannot be set up in elevated sections, because the aisles on two sides of the elevated section are not load-bearing. Currently, there are no specialty high speed railway rescue trains for the rescue of high-speed rail accidents. The rescue of the train derailment accident of Eschede of Germany in Jul. 3, 1998, and the train derailment accident of Wenzhou of China in Jul. 23, 2011 happened in a suburb. Therefore, the rescue effort depended mainly on the local rescue equipment and the local community.

SUMMARY

The present application is directed to a new high-speed rail rescue crane and a multifunctional high-speed rail rescue train, to overcome the defect of the present high-speed rail rescue equipment. The new high-speed rail rescue crane and multifunctional high-speed rail rescue train are suitable in unique terrains, such as elevated sections, tunnels, canyons and water. The new high-speed rail rescue crane and multifunctional high-speed rail rescue train are also suitable for rescue in multi-type accidents of high-speed rails.

According to one aspect of this application, disclosed herein is a new high-speed rail rescue crane comprising: a vehicle equipped with wheels; a concave floor disposed on middle of the vehicle floor; wherein a steel frame base is disposed on the concave floor; a cassette deck is set on both sides of the steel frame base and a V-type chute is set up on the cassette deck; a pedestal floor is disposed on the steel frame base, a sliding tenon is set on both sides of the pedestal floor, the sliding tenons is engaged with the V-type chute; an end of the pedestal floor is connected to a trip lever of a hydraulic cylinder fixed on the steel frame base; a rotary support is fixed on the pedestal floor, a crane is fixed on the pedestal floor; legs of the crane are disposed on the vehicle floor; and a slot engaged with a steel rail is disposed on root of the legs of the crane.

The legs of the crane include eight (8) concave legs that are invertedly fastened to the top surface of the rail and retained to I-type waist of the steel rail. Preferably, the concave leg is fastened and locked on the I-type waist of the steel rail by a sliding block. The diameter of the rotary support is less than the rail gauge (the railway line gauge is 1435 mm). The pedestal floor, the rotary support and the upper components can be horizontally movable (along the direction perpendicular to the steel rail). A cab is disposed on the crane, wherein a signal processor, a computer terminal and a controller are disposed inside of the cab. The top of boom of the crane, the edge of the V-shape chute, the center of the rotary support and the root of the legs are equipped with sensors that communicate with the computer terminal and the signal processor.

According to another aspect of this application, provided herein is a multifunctional high-speed rail rescue train, comprising a rescue command vehicle, a medical ambulance, a firefighting and lighting vehicle, a high-speed rail rescue crane, a rescue and crane auxiliary vehicle, a guidance and recovery vehicle, a drilling and excavate vehicle and mobile reserved vehicles, the multifunctional high-speed rail rescue train comprises a vehicle equipped with wheels and a concave floor is disposed in middle of the vehicle floor, wherein a steel frame base is disposed on the concave floor; a cassette deck is set on both sides of the steel frame base and a V-type chute is set up on the cassette deck; a pedestal floor is disposed on the steel frame base, a sliding tenon is set on both sides of the pedestal floor, the sliding tenons is engaged with the V-type chute; an end of the pedestal floor is connected to a trip lever of a hydraulic cylinder fixed on the steel frame base; a rotary support is fixed on the pedestal floor, a crane is fixed on the pedestal floor; legs of the crane are disposed on the vehicle floor; and a slot engaged with a steel rail is disposed on root of the legs of the crane.

In the high-speed rail wreck crane, the legs of the crane include eight (8) concave legs that are invertedly fastened to the top surface of the rail and retained to I-type waist of the steel rail. Preferably, the concave leg is fastened and locked on the I-type waist of the steel rail by a sliding block. The diameter of the rotary support is less than the rail gauge. The pedestal floor, the rotary support and the upper components of them can be horizontally movable (along the direction perpendicular to the steel rail). A cab is disposed on the crane, wherein a signal processor, a computer terminal and a controller are disposed inside of the cab.

The present high-speed rail rescue crane is safer, more stable and more practical. This multifunctional high-speed rail rescue train is suitable for the rescue of multi-type accident of high-speed rail and it is also suitable in unique terrains, such as elevated sections, tunnels, canyons and water.

It is understood that both the foregoing general description and the following detailed description are exemplary only and are not necessarily restrictive of the disclosure as claimed. The accompanying drawings, which are incorporated in and constitute a part of the specification, illustrate an embodiment of the disclosure and together with the general description, serve to explain the principle of the disclosure.

BRIEF DESCRIPTION OF THE DRAWINGS

The numerous advantages of the present application may be better understood by those skilled in the art by reference to the accompanying figures where.

DETAILED DESCRIPTION

Reference will now be made in detail to the subject matter disclosed, which is illustrated in the accompanying drawings.

Figure 1:
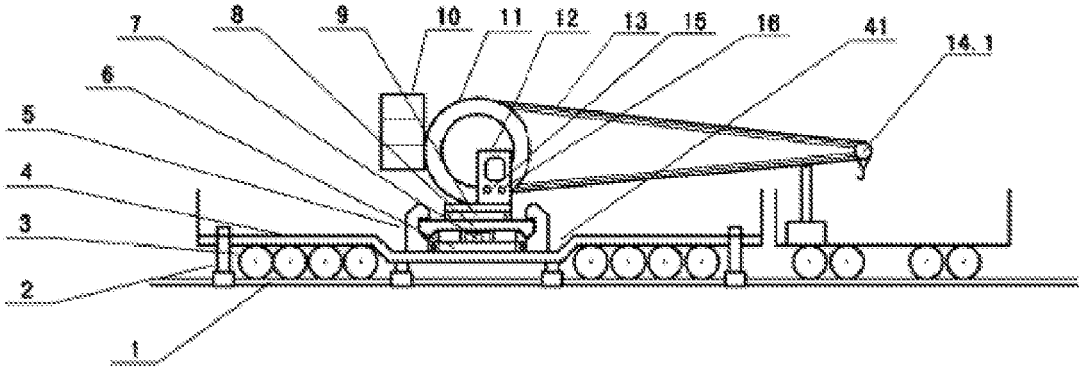
FIG. 1 is a structural schematic drawing of a high-speed rail rescue crane according to the present application.
Figure 2:
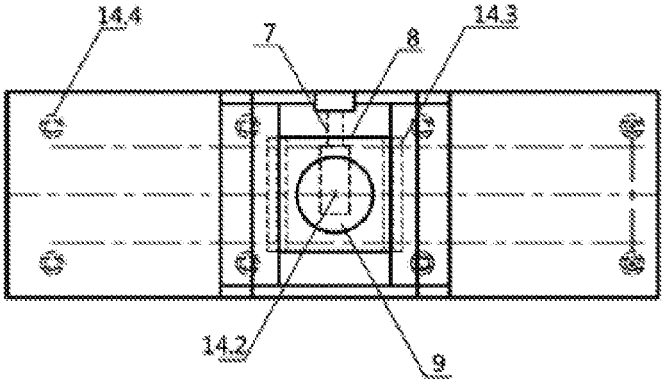
FIG. 2 is an aerial view of the rotary support and steel frame according to the present application.
Figure 3:
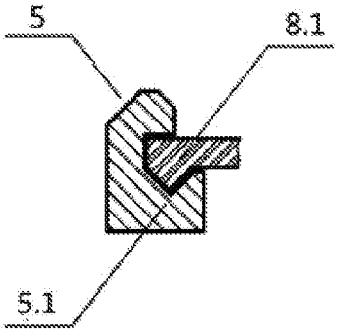
FIG. 3 is a horizontal sectional view of the sliding tenon and V-type chute according to the present application.
Figure 4:
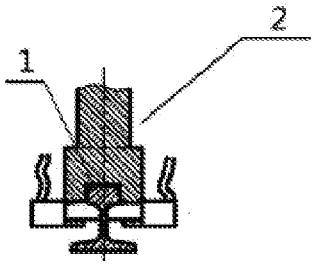
FIG. 4 is a horizontal sectional view of the connection of the crane leg and steel rail according to the present application.

Referring to FIG. 1 and FIG. 3, the present application refers to a new high-speed rail rescue crane comprising: a vehicle equipped with wheels 3 and a concave floor 41 set in the middle of the vehicle floor 4. A steel frame 6 is fixed on the concave floor 41. A cassette deck 5 is set on both sides of the steel frame base 6 and a V-type chute 5.1 is set up on the cassette deck 5. A pedestal floor 8 is fixed on the steel frame base 6, where both sides of a sliding tenon 8.1 is set on. Referring to FIG. 2 and FIG. 3, the sliding tenon 8.1 is engaged with the V-type chute 5.1. The end of the pedestal floor 8 connects with the trip lever 7 of hydraulic cylinder fixed on the steel frame base 6. The trip lever 7 drives the pedestal floor 8. A rotary support 9 is set on the pedestal floor 8, on which the crane 11 is fixed. A crane leg 2 is disposed on the vehicle floor 4. Referring to FIG. 4, there is slot disposed on the end of the leg 2 where the slot couples with rail 1. Bob-weight 10 and drum 11 are disposed on the crane.

The high-speed rail wreck crane is equipped with eight concave legs 2 that are invertedly fastened to the upper apex of the rail and the waist of the I-shaped rail. For example, the concave leg is fastened to the waist of the I-shaped rail by a sliding block. A cab 12 is disposed on the crane, where a signal processor 15, a computer terminal and a controller 16 are disposed. The sensors 14.1-14.4 are disposed on the top of the crane boom 13, the edge of the V-shape chute 5.1, the center of the rotary support 9 and the end of the legs 2. The sensors connect to the computer terminal and controller 16 via a signal processor 15.

Figure 5:
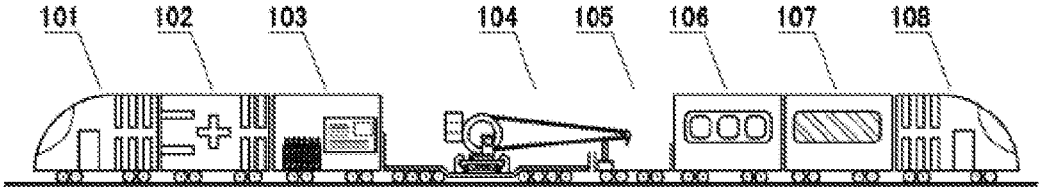
FIG. 5 is a structural view of the basic formation of the multifunctional high-speed rail rescue train according to the present application.
Figure 6:
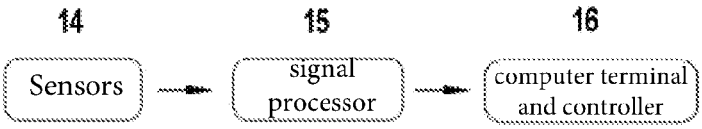
FIG. 6 is a logic control view of the sensors of the rescue crane according to the present application.

According to another aspect of this application, disclosed herein is a multifunctional high-speed rail rescue train, referring to FIG. 5, comprising a rescue command vehicle 101, a medical ambulance 102, a fire fighting vehicle 103, a high-speed rail rescue crane 104, recovery vehicle (crane auxiliary vehicle) 105, a grooming recovery vehicle 106, a drilling mining vehicle 107, and a motor spare vehicle 108. The multifunctional high-speed rail rescue train comprises a vehicle equipped with wheels and a concave floor 41 is disposed in the middle of the vehicle floor 4. A steel frame 6 is fixed on the concave floor 41. A cassette deck 5 is set on both sides of the steel frame base 6 and a V-type chute 5.1 is set up on the cassette deck 5. A pedestal floor 8 is fixed on the steel frame base 6, where both sides of a sliding tenon 8.1 is set on. The sliding tenon 8.1 is engaged with the V-type chute 5.1. The end of the pedestal floor 8 connects with trip lever 7 of hydraulic cylinder fixed on the steel frame base. A rotary support 9 is disposed on the pedestal floor 8, where the crane is fixed. A crane leg 2 is disposed on the vehicle floor 8. There is slot on the end of the leg 2 where the slot couples with rail 1.

The high-speed rail wreck crane is equipped with eight concave legs 2 which are invertedly fastening to the upper apex of the rail and the waist of the I-shaped rail. For example, the concave leg is fasted to the waist of the I-shaped rail by the sliding block. The cab 12 is disposed on the crane, where the crane comprises a signal processor 15, a computer terminal and a controller 16. The sensors 14 are disposed on the top of the crane boom, at the edge of the V-shape chute, in the center of the rotary support and at the end of the legs. The sensor 14 connects to the computer terminal and controller 16 via a signal processor 15.

Referring to FIG. 1 and FIG. 2, to overcome and solve the problem with short legs (the railway line gauge is 1435 mm) which leads to vehicle rollover, the embodiments described herein adopts the following stable and firm measures: the steel frame base of an existing rail rescue crane is disposed on a platform trailer, however, in this application, the steel frame base is fixed on the concave floor 41 to lower the crane barycenter (center of gravity) so that stability is improved. The rail concave platform trailer is refitted to special vehicle for high-speed rail rescue. The vehicle floor 4, 41 and its frame structure are integrated with the steel frame 6, leg 2, vehicle floor 8, rotary support 9 and V-type chute 5.1 to enhance stability. To reduce the diameter of the rotary support 9, the diameter of the rotary support is within the range of 1200 mm to 1300 mm (less than the railway line gauge which is 1435 mm). The center of the rotary support 9 and the crane boom cannot cross the gauge line of the side of the acting force, as this would lead to an unbalanced barycenter. The V-type chute 5.1 is disposed on both ends of the concave floor 41 of the platform trailer to support vehicle floor 8 and its superstructure. The pedestal floor 8 connects with trip lever 7 of hydraulic cylinder to make the pedestal floor 8, rotary support 9 and its superstructure move horizontally which increases the distance of the center of the rotary support 9 to the most stressed legs 2. In doing so, stability is realized and guaranteed. Meanwhile, the computer system of the rescue crane monitors safety and surveils the key parts of the rescue crane via sensors 14.1-14.4 and signal processor 15. The computer terminal and the controller 16 display and warn the user based on the various states of the equipment. This ensures correct operation of the equipment.

Multifunctional marshalling high-speed rail rescue trains 101-108 are satisfied with the command of "parallel operation", that is, the rescue trains can stop at an adjacent station before arriving at the place of the accident. The train 101-103 of number 1-3 arrive on an adjacent rail to rescue the wounded and evacuate passengers. Number 4-8 of the train 104-108 gets ready to rescue. After the rescue is completed, the rescue within unique terrain begins. The multifunctional high-speed rail rescue trains 101-108 are suitable in unique terrains, such as elevated sections, tunnels, canyons and water. The new high-speed rail rescue crane and multifunctional high-speed rail rescue train are also suitable for the technical rescue of multi-type accident of high-speed rail.

Marshalling High-speed rail Rescue Train

| Marshalling train number | Vehicles properties | On-board equipments | Vehicle Member | Remarks |
|---|---|---|---|---|
| Train 1 | 101. Rescue Command vehicle | 1. radio communication, wired communication facility;<br>2. Rescue radio and hand microphone;<br>3. safety supervision recording, video recording and the related equipment of accident investigation | Emergency rescue commanding officers, special or department managers, safety inspectors | First train, locomotive cab and rescue command, rescue services, monitor, survey |
| Train 2 | 102. medical ambulance | 1. First aid equipment, first-aid medicines and first-aid bed for trauma patients;<br>2. Disinfection and epidemic prevention drugs | Medical and epidemic prevention staff | Equipment for blood transfusion, oxygen transfusion and transfusion can be performed in emergency tents if necessary. |
| Train 3 | 103. fire fighting vehicle | 1. fire fighting and ventilation equipment;<br>2. Power generators, power equipment, external power for meeting the needs of the emergency scene which require a power supply;<br>3. Serving simple pasta, bread, drinking water and other emergency food;<br>4. Emergency tents, cots and other first-aid supplies | Fire suppression, generator sets, tunnel ventilation and living supply staff | General chemical fires, electric fires and general fire extinguishing equipment, emergency tents, 30, a simple folding table or chair20 |
| Train 4 and 5 | 104. 105 Rescue crane | Comprehensive rescue crane, comprising a leg fastening the rail automatically and steadily, whose elevating capacity is 120T of base boom, 60T of the secondary boom (8 shaft and the shaft weight is within 16T)<br>1. Manage the derailed locomotive vehicle by lifting portions of the train;<br>2. Pull out the locomotive vehicle subversion in tunnel by strong traction | The operators of the comprehensive rescue crane | Suitable for high speed rail rescue crane (the weight of high-speed train is about 50T) |
| Train 6 | 106. grooming recovery vehicle | 1. An assault boats, a rubber valve, an aerial ladder, a hanging ladder and other pontoon bridge equipment;<br>2. various re-railer, lifting jack, fluctuating short rail, sleeper and so on;<br>3. track skeleton, sleepers, ballast material, cement and sand. | Assault boats, rubber valve, pontoon bridge equipment and fluctuating rescue staff | Natural disaster, such as rock fall, flood, earthquake or the accident occurred in bridge, tunnel, elevated and waters where the pontoon bridge equipment is required. to evacuate passenger |
| Train 7 | 107. drilling mining vehicle | 1. Drilling equipment, drainage equipment and life detectors and so on;<br>2. Forcible division in rescue requires cutting device;<br>3. Excavators, loaders, dump trucks and earth removal vehicles | the appropriate staff of drilling, drainage, search and rescue and the earth rotation | An excavator, a loader and two dump trucks |
| Train 8 | 108. store maneuver | Amplified emergency rescue and other emergency services | Relevant staff | Caboose, locomotive cabs, and rescue emergency standby |

What is claimed is:

1. A rail rescue crane comprising: a vehicle equipped with wheels; and a concave floor disposed on middle of the vehicle floor; wherein a steel frame base is disposed on the concave floor; a cassette deck is set on both sides of the steel frame base and a V-type chute is set on the cassette deck; a pedestal floor is disposed on the steel frame base; a sliding tenon is set on both sides of the pedestal floor, wherein the sliding tenon is engaged with the V-type chute; an end of the pedestal floor is connected to a trip lever of a hydraulic cylinder fixed on the steel frame base; a rotary support is fixed on the pedestal floor, a crane is fixed on the pedestal floor; legs of the crane are disposed on the vehicle floor; and a slot engaged with a steel rail is disposed on root of the legs of the crane, wherein the legs of the crane comprise eight concave legs that are invertedly fastened to the top surface of the rail and retained to an I-type waist of the steel rail.

2. The rail rescue crane of claim 1, wherein the concave leg is fastened and locked onto the I-type waist of the steel rail by a sliding block.

3. The rail rescue crane of claim 1, further comprising a cab disposed on the crane; wherein the cab comprises a signal processor, a computer terminal and a controller disposed inside of the cab.

4. The rail rescue crane of claim 3, wherein the top of boom of the crane, the edge of the V-shape chute, the center of the rotary support and the root of the legs are equipped with sensors that communicated with the computer terminal and the signal processor.

5. The rail rescue crane of claim 1, wherein diameter of the rotary support is less than the rail gauge.

6. The rail rescue crane of claim 1, wherein the pedestal floor, the rotary support and the upper components of them can be horizontally movable, and the center of the rotary support and the crane boom do not cross the gauge line on the side of the acting force.

7. A multifunctional rail rescue train comprising a rescue command vehicle; a medical ambulance; a firefighting vehicle; a high-speed rail rescue crane; a rescue and crane auxiliary vehicle; and a drilling and excavate vehicle; and a rail rescue crane, wherein the rail rescue crane further comprises a vehicle equipped with wheels; and a concave floor is disposed in middle of the vehicle floor, wherein: a steel frame base is disposed on the concave floor; a cassette deck is set on both sides of the steel frame base and a V-type chute is set on the cassette deck; a pedestal floor is disposed on the steel frame base; a sliding tenon is set on both sides of the pedestal floor, wherein the sliding tenon is engaged with the V-type chute; an end of the pedestal floor is connected to a trip lever of a hydraulic cylinder fixed on the steel frame base; a rotary support is fixed on the pedestal floor, a crane is fixed on the pedestal floor; legs of the crane are disposed on the vehicle floor; and a slot engaged with a steel rail is disposed on root of the legs of the crane, wherein the legs of the crane comprise eight concave legs that are invertedly fastened to the top surface of the rail and retained to an I-type waist of the steel rail.

8. The rail rescue crane of claim 7, wherein the concave leg is fastened and locked onto the I-type waist of the steel rail by a sliding block.

9. The rail rescue crane of claim 7, further comprising a cab disposed on the crane; wherein the cab comprises a signal processor, a computer terminal and a controller disposed inside of the cab.

10. The rail rescue crane of claim 9, wherein the top of boom of the crane, the edge of the V-shape chute, the center of the rotary support and the root of the legs are equipped with sensors that communicated with the computer terminal and the signal processor.

11. The rail rescue crane of claim 7, wherein diameter of the rotary support is less than the rail gauge.

12. The rail rescue crane of claim 7, wherein the pedestal floor, the rotary support and the upper components of them can be horizontally movable, and the center of the rotary support and the crane boom do not cross the gauge line on the side of the acting force.

* * * * *